United States Patent [19]

Aguro et al.

[11] 4,426,151

[45] Jan. 17, 1984

[54] CLEANING DEVICE FOR CLEANING AN IMAGE BEARING MEMBER WITH DEVELOPER

[75] Inventors: Yoshinori Aguro, Yokohama; Akiyoshi Torigai, Machida, both of Japan

[73] Assignee: Canon Kabushiki Kaisha, Tokyo, Japan

[21] Appl. No.: 330,018

[22] Filed: Dec. 11, 1981

[30] Foreign Application Priority Data

Dec. 23, 1980 [JP] Japan ..... 55-183125

[51] Int. Cl.[3] ..... G03G 21/00

[52] U.S. Cl. ..... 355/15; 118/652; 15/256.52

[58] Field of Search ..... 355/15, 3 R; 118/652; 430/125; 15/256.5, 256.51, 256.52, 1.5

[56] References Cited

U.S. PATENT DOCUMENTS

| | | | |
|---|---|---|---|
| 3,637,306 | 1/1972 | Cooper | 355/15 |
| 4,003,651 | 1/1977 | Hashida et al. | 355/15 X |
| 4,111,545 | 9/1978 | Meltzer | 355/15 |
| 4,154,522 | 5/1979 | Ikesue | 355/15 |
| 4,320,958 | 3/1982 | Fantuzzo | 355/3 DD |
| 4,325,628 | 4/1982 | Torigai et al. | 355/15 |

*Primary Examiner*—R. L. Moses

*Attorney, Agent, or Firm*—Fitzpatrick, Cella, Harper & Scinto

[57] ABSTRACT

A cleaning device for removing excess developer which remains on the image bearing member of an image formation apparatus after transfer of a developed image has a conveyor for conveying developer to a position which faces the image bearing member, and a device for bringing the conveyed developer into contact with the surface of the image bearing member to effect cleaning.

16 Claims, 7 Drawing Figures

CLEANING DEVICE FOR CLEANING AN IMAGE BEARING MEMBER WITH DEVELOPER

BACKGROUND OF THE INVENTION

1. Field of the Invention

This invention relates to a cleaning device, and more particularly to a cleaning device in an image formation apparatus in which a magnetic developer image is formed on an endlessly moving image bearing member and transferred to a transfer medium, whereafter the surface of the image bearing member is cleaned for reuse.

2. Description of the Prior Art

In various types of image formation apparatus such as image formation apparatus in which an electrostatic latent image is formed on an image bearing member such as an electrophotographic photosensitive medium and developed and transferred and image formation apparatus in which a magnetic latent image is formed on a magnetic recording medium and developed and transferred, the image bearing member is cleaned for repetitive utilization.

As the cleaning device for the image bearing members of these image formation apparatus, the fur brush system, the web system, the magnetic brush system or the blade system has heretofore been put into practical use.

Dust, tobacco smoke, etc. in the environment adhere to the surface of the image bearing member of the image formation apparatus and impregnant or the like of the transfer medium also adheres thereto. These adhering materials cannot always be removed satisfactorily by the conventional cleaning systems. Moreover, if deterioration of the image bearing member progresses due to the action of corona ions or the like, it adversely affects the image formation.

For the purpose of removing such adhering materials, it has been proposed to apply a polishing action to the surface of the image bearing member. Specifically, the polishing action is effected by polishing means comprising a polishing member such as polishing cloth slidably disposed at a position subsequent to the cleaning means or by polishing means provided with a mechanism for supplying a polishing agent to the surface of the image bearing member and a mechanism for causing the polishing agent to frictionally contact the surface of the image bearing member. However, where exclusive an polishing means is provided, there has been required space to accommodate the polishing means within the image formation apparatus and it has been necessary to add a complex mechanism. This provides a hindrance particularly in making the image formation apparatus compact.

The present invention has been made in view of the above-noted point.

SUMMARY OF THE INVENTION

It is an object of the present invention to provide a novel and excellent cleaning device.

It is another object of the present invention to provide a cleaning device which can maintain a uniform frictional contact effect.

The device of the present invention is a cleaning device in an image formation apparatus in which a magnetic developer image is formed on an endlessly moving image bearing member and transferred to a transfer medium, whereafter the surface of the image bearing member is cleaned for reuse, characterized by cleaning means bearing against the surface of the image bearing member, catching and conveying magnetic means disposed upstream of the bearing position of the cleaning means in the direction of movement of the image bearing member, and a scraper member serving to heap up the magnetic developer on the catching and conveying magnetic means toward the image bearing member.

With the above-described construction, developer is brought into frictional contact with the surface of the image bearing member before the cleaning member acts, thereby enabling the removal of adhering materials which has been difficult with the conventional systems. It is effective to mix a polishing agent with the developer as required. Moreover, the developer can be supplied to the surface of the image bearing member before the cleaning member acts and therefore, even if the developer partly adheres to the surface of the image bearing member after the image transfer, the developer can be uniformized and a uniform frictional contact action is enabled by the cleaning member. Incidentally, where non-uniform residual developer is frictionally removed by the cleaning member, the force applied to the portion of the cleaning member which bears against the image bearing member has become non-uniform in accordance with the condition of the developer adhering to the image bearing member. Creation of the partial concentration of pressure is liable to cause abrasion or damage of the image bearing member and is also liable to result in unsatisfactory cleaning. However, with the construction of the present invention, a uniform force is dispersed over the entire portion of the cleaning member which bears against the image bearing member, whereby the abovenoted problems are eliminated.

Particularly, in the case of the so-called counter blade system in which an elastic cleaning blade is disposed so that the edge thereof opposes the direction of movement of the image bearing member, the above-described effect is more pronounced. At the position whereat the cleaning member bears against the image bearing member, the cleaning member not only blocks the passage of the developer on the image bearing member and separates the developer from the image bearing member but also enables more complete removal of the adhering materials to be accomplished by the frictional contact operation of the cleaning member resulting from the cooperation thereof with the developer.

Other objects, features and operational effects of the present invention will become apparent from the following detailed description of specific embodiments of the invention taken in conjunction with the accompanying drawings.

DESCRIPTION OF THE PREFERRED EMBODIMENTS

Figure 1:
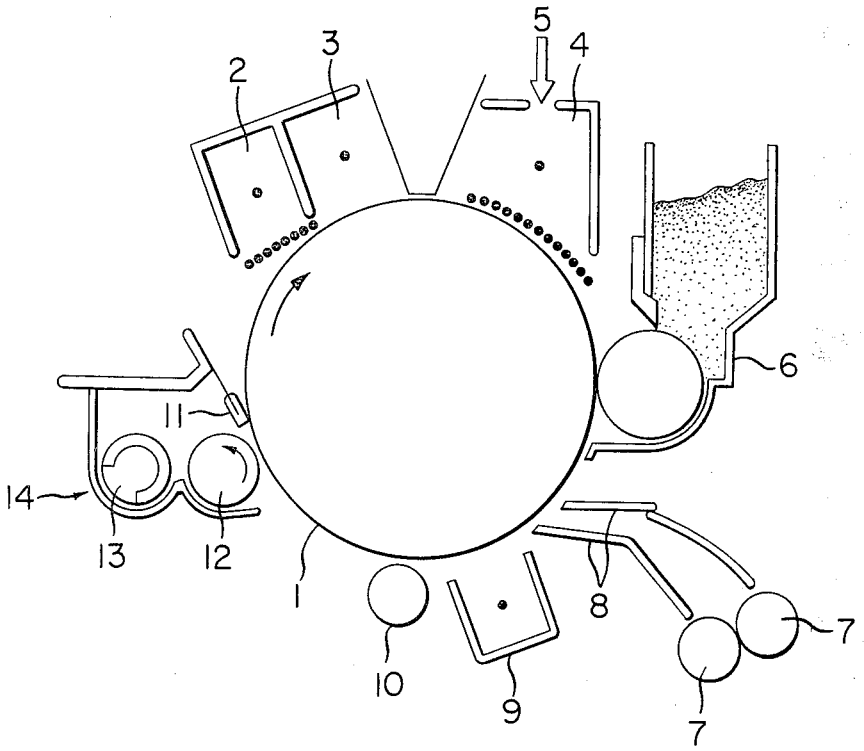
FIG. 1 (PRIOR ART)
FIG. 1 shows an example of an image formation apparatus to which the device of the present invention is applied.

FIG. 1 is a side view illustrating an image formation apparatus to which the device according to the present invention is applied.

In FIG. 1, a photosensitive drum (image bearing member) 1 has the memory thereon removed by a pre-discharging corona discharger 2, whereafter it is uniformly charged by a primary cornoa discharger 3 and is subjected to secondary discharging by a corona discharger 4 while, at the same time, it is exposed to an image light 5 corresponding to an original, whereby an electrostatic latent image is formed on the photosensitive drum 1, whereafter the latent image is developed into a toner image by a developing device 6 using magnetic developer (toner). The toner image is transferred to a transfer medium, supplied from rollers 7 through a guide 8, by a corona opposite in polarity to the toner and imparted to the transfer medium from the back side thereof by an image transfer corona discharger 9. The transfer medium having the copy image transferred thereto is separated from the photosensitive drum by separating means such as a separating roller 10, and is conveyed to fixing means, not shown.

On the other hand, the photosensitive drum has any residual toner on the surface thereof removed by a cleaner 14 and is used repetitively. The conventional cleaner 14 shown comprising a cleaning blade 11 having its edge bearing against the surface of the photosensitive drum, a catching magnet roller 12 and a collecting screw 13. The magnetic toner removed by the blade 11 is caught by the magnet roller 12 and forms a toner brush on the surface of the magnet roller 12. The toner brush is maintained at a predetermined thickness by a scraper which serves also as a casing, and the excess toner is scraped and conveyed by the collecting screw 13.

In the image formation apparatus of the described construction, foreign materials adhering to the drum surface from the transfer medium or substances produced by the corona discharge and adhering to the drum surface cannot be removed by the aforementioned cleaning blade, but rather form coatings which rigidly adhere to the drum surface, and these adhering films adsorb humidity particularly under a high humidity environment and reduce the surface resistance of the drum surface, thereby disturbing the latent image thereon.

The polishing action by toner particles is effective for the removal of these foreign materials and particularly, if polishing powder such as cerium oxide is mixed with the toner, the effect will be greater. However, the amount of toner adhering to the drum surface depends on the original to be formed, and the amount of toner supplied to the blade portion is not constant. In an extreme case, if an original approximate to blank paper is continuously used, the toner or polishing powder accumulating on the blade portion will become almost null and the removal of the substances adhering to the drum surface by the polishing effect cannot be achieved. A latent image area for supplying toner may be provided outside the image area to ensure toner or polishing powder to be always supplied, but in such case the amount of toner consumed would be increased and the contamination of the interior of the apparatus would also be increased.

Figure 2A:
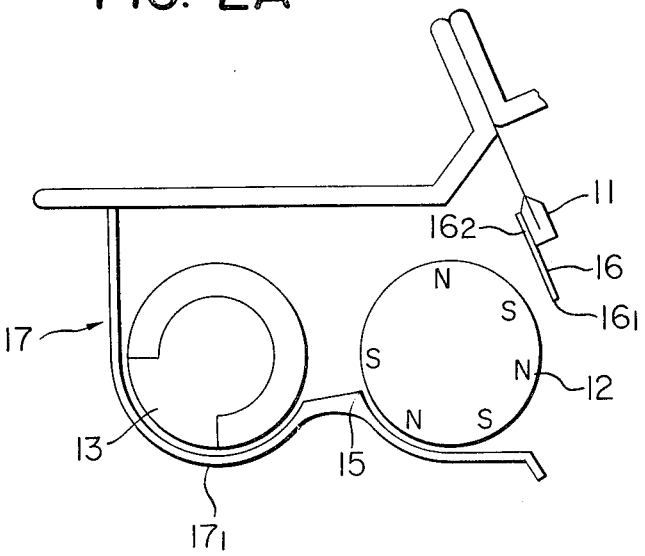
FIGS. 2A and 2B are side views of a specific embodiment of the cleaning device according to the present invention, FIG. 2A showing a non-cleaning condition and FIG. 2B showing a cleaning condition.
Figure 2B:
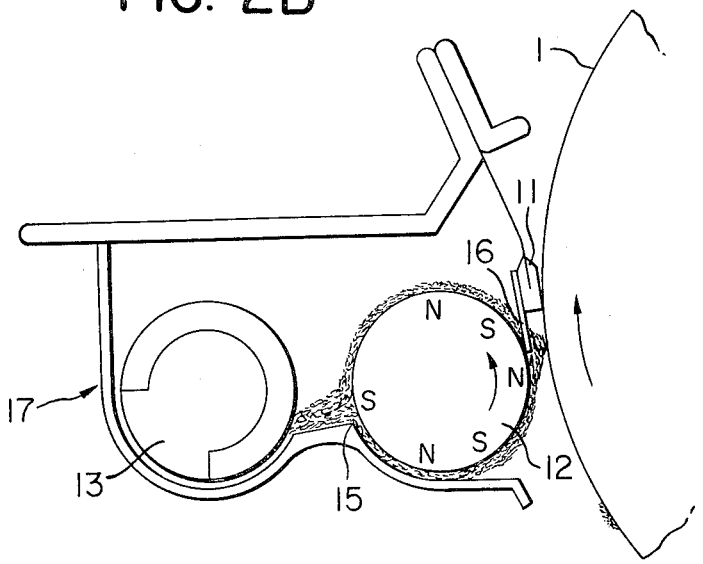

FIGS. 2A and 2B illustrate the cleaning device 17 according to the present invention. FIG. 2A shows the cleaning device spaced apart from the photosensitive drum surface, and FIG. 2B shows the cleaning device installed at the photosensitive drum cleaning position.

One end $16_2$ of a scraper member 16 is secured to the back side of the blade 11 of the cleaning device. The blade 11 has its edge portion formed of an elastic material such as rubber or synthetic resin. Alternatively, the entire blade may be formed of a suitable elastic material or, as shown, only the tip end portion of the blade may be formed of an elastic material and the support portion may be formed of a flexible metal such as phosphor bronze. When the blade 11 is spaced from the surface of the image bearing member (FIG. 2A), the free end $16_1$ of the scraper member 16 is spaced apart from the magnet roller, but when the blade 11 is in a condition in which it is installed at the cleaning operation position (FIG. 2B), the free end $16_1$ of the scraper member 16 moves to a position in which it is in proximity or contact with the surface of the magnet roller 12 which faces the photosensitive drum.

Figure 3:
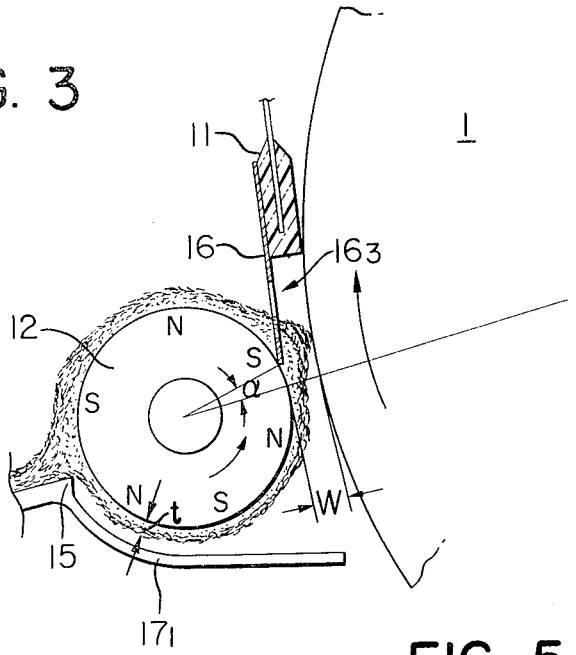
FIG. 3 is an enlarged view of the portions of the FIG. 2 device which neighbor the photosensitive drum.
Figure 4:
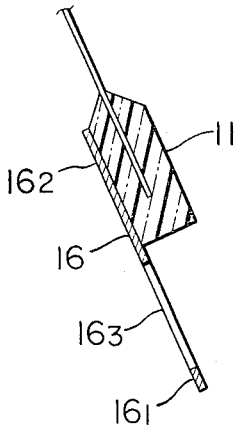
FIG. 4 is an enlarged side view of the cleaning blade and scraper member of the FIG. 2 cleaning device.

This scraper member 16, as shown in the cross-sectional view of FIG. 3 which shows the scraper member with the blade and in the fragmentary front view of FIG. 4, has a plurality of openings $16_3$ provided in the central connecting portion leading from the free end $16_1$ of the scraper member to the blade mounting portion.

Accordingly, when the magnetic developer caught and conveyed by the surface of the magnet roller 12 arrives at the position of the free end $16_1$ of the scraper 16 which faces the photosensitive drum, the magnetic developer is heaped up from the roller surface by the free end $16_1$ of the scraper 16 to ensure the contact of the developer with the photosensitive drum surface. In this manner, the end of the heap of the magnetic developer and/or the polishing agent frictionally slides on the photosensitive drum surface and part thereof is replenished, whereby sufficient polishing cleaning is accomplished at the cleaning blade position. On the other hand, any developer remaining on the free end $16_1$ of the scraper member circulates through the openings $16_3$ provided in the connecting portion leading from the free end $16_1$ to the blade.

The developer and/or the polishing agent removed by the cleaning blade also passed through the said openings and is caught and conveyed by the magnet roller surface. Any excess developer on the magnet roller surface is scraped off by a scraper (regulating member) 15 provided in the lower portion of the casing, whereby the thickness of the layer of developer on the magnet roller 12 is made constant.

In this manner, stable supply of the developer and/or the polishing agent to the photosensitive drum surface is accomplished to provide a sufficient cleaning effect.

FIG. 3 is an enlarged view of the neighborhood of the photosensitive drum of the apparatus shown in FIG. 2B.

The magnet roller 12 is disposed on the bottom $17_1$ of the housing of the cleaning device 17 and in proximity to the photosensitive drum. The minimum clearance between the two is indicated as W. As mentioned hereinbefore, part of the collected developer is left on the magnet roller surface with a predetermined layer thickness t by the regulating member 15 provided at the housing bottom $17_1$ and the circulation of such developer is utilized. The developer layer thickness t is set to a value somewhat smaller than the minimum clearance W between the surface of the photosensitive drum 1 and the magnet roller 12. (For example, t=0.7 mm for W=1 mm). By this, the heaping-up effect of the scraper member is sufficiently provided. On the other hand, the position of contact of the free end $16_1$ of the scraper member 16 with the magnet roller 12 is set so that the heap-up peak of the developer layer is a position exceeding the miminum clearance W. That is, the position of contact of the free end $16_1$ of the scraper member 16 lies in the area on the movement direction side of the magnet roller relative to the line passing through the centers of the magnet roller and the photosensitive drum. $\alpha$ is the angle formed between said line and a radial line from the center of the magnet roller to the position of contact. ($\alpha>0$) By so setting the scraper member 16, falling and scattering of scattered toner caused during the contact with the photosensitive drum surface at the heap-up peak of the developer layer may be prevented. That is, for example, even if scattered toner is created on the peak, the toner is required to pass through the narrowest portion between the magnet roller and the photosensitive drum and therefore, the toner is again caught by the magnet roller surface. Accordingly, there is no possibility that toner leaks from between the housing bottom $17_1$ of the cleaning device and the photosensitive drum.

When the developer layer is to be heaped up by the scraper member, it is necessary that sufficient heap-up be formed and the peak of the heap-up keeps sufficient contact with the photosensitive drum surface.

In order to set the amount of this heap-up as desired, it is effective to prescribe the width A of the free end $16_1$ portion of the scraper member, namely, the length from the free end $16_1$ to the lower end of the opening $16_3$(see FIG. 5), to a suitable condition. By making this width A sufficiently great, the amount of heap-up can be increased and the peak thereof can also be heightened. On the other hand, if the width A is decreased, the amount of heap-up can be decreased and the peak thereof can also be lowered. For example, where a Mylar (trade name) sheet having a thickness of 100$\mu$ is used as the scraper member, if the width A is 1.5 mm or greater in the shown arrangement, there will be obtained a sufficient heap-up which will act on the photosensitive drum surface. At this time, the minimum clearance W=1.0 mm and the developer layer thickness of t=0.7 mm.

A non-magnetic material is required as the scraper member, and a desired material such as a metal sheet of phosphor bronze or stainless steel or synthetic resin such as Mylar may be chosen for the scraper member. However, where the scraper member is disposed in the narrow space between the magnet roll and the photosensitive drum as in the device shown, the shown example of the sheet-like member is suitable for the setting of the amount of heap-up. For example, in the case of Mylar, 50$\mu$ or greater would be sufficiently practical. In the case of a metal sheet or the like having high flexibility and strength, the thickness of the sheet may be smaller.

On the other hand, in the case of a material of weak strength, the sheet thickness of the scraper member itself may be made great and the free end thereof may be formed into a wedge-like shape.

In the above-described specific example of the device, the scraper member is fixed to the blade so as to be operatively associated with the latter, but the scraper member may of course be provided independently of the cleaning means. However, where the scraper member is operatively associated with the cleaning member is shown in the specific example, the following effect is obtained.

In case of the so-called counter arrangement in which the blade is disposed in a direction counter to the direction of movement of the photosensitive drum as shown, when supplied with excessive developer and/or polishing agent, the wedge-shaped space defined by the blade edge portion and the photo-sensitive drum surface is filled with developer and a great compression force is applied to the blade itself to cause it to move along the direction of movement of the photosensitive drum. In response thereto, the scraper member also moves and therefore, the free end of the scraper member becomes spaced apart from the magnet roller surface and the heap-up of developer is decreased. Therefore, the amount of developer supplied to the cleaning station is decreased, so that the filling rate of the wedge-shaped space with developer is alleviated to provide a suitable amount of developer. On the other hand, where the amount of developer supplied to the wedge-shaped space is small, the compression force applied to the blade is decreased and the blade itself becomes stretched in a counter direction. At this time, the scraper member comes into its closest proximity or contact with the magnet roller surface to thereby provide a large heap-up of developer layer. Thus, the amount of developer supplied is increased, so that the filling of the wedge-shaped space of the blade with developer is promoted and a good cleaning force can be obtained for moderate compression. Thus, in the construction of the above-described specific example, the position of the scraper member can be very well prescribed so that the cleaning action of the cleaning blade may always be maintained suitable.

Figure 5:
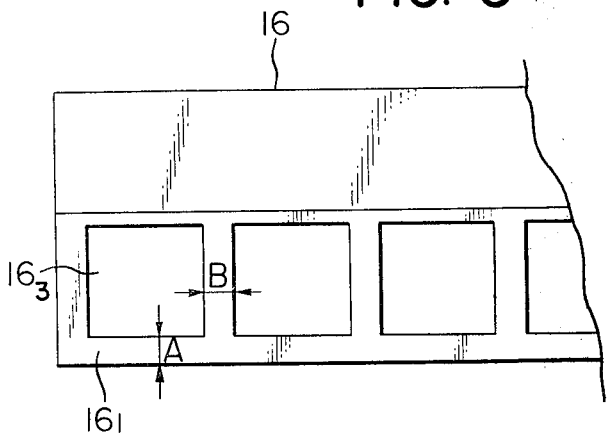
FIG. 5 is a front view of the scraper member.
Figure 6:
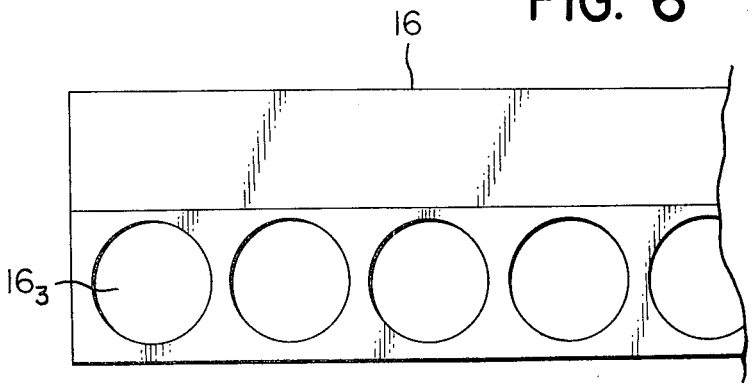
FIG. 6 is a front view showing a modified form of the openings in the scraper member.

The openings formed in the scraper member may be square shaped as shown in FIG. 5, but alternatively they may be circular as shown in FIG. 6. Of course, other shapes may also be adopted.

Of course, the scraper member may be formed by punching a sheet-like body so as to provide openings therein, and a plurality of combtooth-like support lines may be studded on a band-like sheet corresponding to the end portion which acts on the magnet roller and the ends of the support lines may be fixed to the blade side.

As described above in detail with respect to the specific example, the device of the present invention is an excellent one which displays a sufficiently good cleaning effect even in a case where adhering materials which could not be removed by the conventional cleaning means are present on the surface of an image bearing member such as a photosensitive drum.

What we claim is:

1. An image formation apparatus comprising:

a movable image bearing member;

means for forming a developed image on said image bearing member with a dry developer;

means for transferring the developed image to a transfer material; and a cleaning device, provided downstream of said transfer means with respect to the moving direction of said image bearing member, for removing developer remaining on the surface of said image bearing member, said cleaning device including means for conveying dry developer toward said image bearing member and means for bringing the developer on said conveying means into contact with the surface of said image bearing member to effect cleaning.

2. An apparatus according to claim 1, wherein said conveying means is a magnet roller for conveying dry magnetic developer.

3. An apparatus according to claim 1, wherein said means for bringing the developer into contact with the surface of said image bearing member has a scraper member.

4. An apparatus according to claim 1, wherein said conveying means has a developer layer thickness regulating member.

5. An apparatus according to claim 4, wherein said developer layer thickness regulating member sets the developer layer thickness t to a value smaller than the minimum clearance W between said conveying means and said image bearing member.

6. An apparatus according to claim 3, wherein said scraper member has one end supported and the other end is a free end in proximity or in contact with said conveying means.

7. A cleaning device for removing dry developer remaining on the surface of a movable image bearing member of an image formation apparatus after a developed image thereon is transferred, comprising;

cleaning means for engaging the surface of the image bearing member;

developer conveying means for conveying dry developer and disposed upstream of the engaging portion of said cleaning means with respect to the direction of movement of the image bearing member; and means for bringing the developer on said conveying means into contact with the surface of the image bearing member.

8. A cleaning device according to claim 7, wherein said conveying means is a magnet roller for conveying magnetic developer.

9. A cleaning device according to claim 7, wherein said means for bringing the developer into contact with the surface of the image bearing member has a scraper member.

10. A cleaning device according to claim 7, wherein said conveying means has a developer layer thickness regulating member.

11. A cleaning device according to claim 10, wherein said developer layer thickness regulating member sets the developer layer thickness t to a value smaller than the minimum clearance between said means and the image bearing member.

12. A cleaning device according to claim 9, wherein said scraper member has one end supported and the other end is a free end and is brought into proximity or contact with said conveying means.

13. A cleaning device according to claim 7, wherein said cleaning means is an elastic blade.

14. A cleaning device according to claim 13, wherein said means for bringing the developer into contact with the surface of the image bearing member has a scraper member connected to said elastic blade.

15. A cleaning device according to claim 14, wherein said scraper member has a plurality of openings therein.

16. A cleaning device according to claim 9, wherein said scraper member brings the developer into contact with the surface of the image bearing member at a position after it has passed the minimum clearance between said conveying means and said image bearing member.

* * * * *

UNITED STATES PATENT AND TRADEMARK OFFICE

CERTIFICATE OF CORRECTION

PATENT NO. : 4,426,151

DATED : January 17, 1984

INVENTOR(S) : YOSHINORI AGURO, ET AL.

It is certified that error appears in the above-identified patent and that said Letters Patent is hereby corrected as shown below:

Column 1, line 48, "exclusive an" should read --an exclusive--.

Column 2, line 35, "abovenoted" should read --above-noted--.

Column 3, line 12, "cornoa" should read --corona--;
line 32, "comprising" should read --comprises--;
line 49, "adsorb" should read --absorb--.

Column 4, line 20, "operation" should read --operative--.

Column 5, line 22, "on the peak" should read --at the peak--.

Signed and Sealed this

*Fifteenth* Day of *May 1984*

[SEAL]

*Attest:*

GERALD J. MOSSINGHOFF

*Attesting Officer*

*Commissioner of Patents and Trademarks*